US010655428B2

(12) United States Patent
Giroux et al.

(10) Patent No.: US 10,655,428 B2
(45) Date of Patent: May 19, 2020

(54) FLOW CONTROL DEVICE

(71) Applicant: Weatherford Technology Holdings, LLC, Houston, TX (US)

(72) Inventors: Richard L. Giroux, Bellville, TX (US); Michael J Sepulveda, Houston, TX (US); Joshua Vernon Symms, Cypress, TX (US); Jobby T. Jacob, Sugar Land, TX (US)

(73) Assignee: Weatherford Technology Holdings, LLC, Houston, TX (US)

( * ) Notice: Subject to any disclaimer, the term of this patent is extended or adjusted under 35 U.S.C. 154(b) by 189 days.

(21) Appl. No.: 15/838,023

(22) Filed: Dec. 11, 2017

(65) Prior Publication Data

US 2019/0178052 A1 Jun. 13, 2019

(51) Int. Cl.

| | |
|---|---|
| ***E21B 33/14*** | (2006.01) |
| ***E21B 34/14*** | (2006.01) |
| ***E21B 34/08*** | (2006.01) |
| *E21B 34/00* | (2006.01) |

(52) U.S. Cl.

CPC ..... *E21B 33/146* (2013.01); *E21B 34/08* (2013.01); *E21B 34/14* (2013.01); *E21B 2034/007* (2013.01)

(58) Field of Classification Search

CPC .. E21B 34/14; E21B 2034/007; E21B 33/146; E21B 33/14

See application file for complete search history.

(56) References Cited

U.S. PATENT DOCUMENTS

| | | | | |
|---|---|---|---|---|
| 2,925,865 | A | 2/1960 | Oliver | |
| 4,176,717 | A | 12/1979 | Hix | |
| 4,674,569 | A | 6/1987 | Revils et al. | |
| 7,252,152 | B2 * | 8/2007 | LoGiudice | E21B 17/1028 166/386 |
| 8,944,167 | B2 * | 2/2015 | Ravensbergen | E21B 34/102 166/177.5 |
| 9,121,255 | B2 * | 9/2015 | Themig | E21B 21/103 |

* cited by examiner

*Primary Examiner* — Catherine Loikith

(74) *Attorney, Agent, or Firm* — Patterson + Sheridan, LLP

(57) ABSTRACT

A flow control apparatus includes a housing having a bore extending and a port formed through a wall of the housing; and a port sleeve disposed in the housing and having a port in communication with the port of the housing. The apparatus also includes a first sleeve releasably attached to the housing, wherein the first sleeve is movable from a first position preventing axial movement of the port sleeve relative to the housing to a second position allowing axial movement of the port sleeve relative to the housing. The apparatus further includes a second sleeve releasably attached to the port sleeve, wherein the second sleeve is movable from a first position blocking fluid communication through the port of housing and the port of the port sleeve to a second position allowing fluid communication through the ports.

29 Claims, 18 Drawing Sheets

FLOW CONTROL DEVICE

BACKGROUND OF THE INVENTION

Field of the Invention

Embodiments of the present invention relate to apparatus and methods of cementing a tubular. Particularly, embodiments disclosed herein relate to a flow control device for flowing cement.

Description of the Related Art

A wellbore is formed to access hydrocarbon bearing formations, e.g. crude oil and/or natural gas, or geothermal formations by the use of drilling. Drilling is accomplished by utilizing a drill bit that is mounted on the end of a tubular string, such as a drill string. To drill within the wellbore to a predetermined depth, the drill string is often rotated by a top drive or rotary table on a surface platform or rig, and/or by a downhole motor mounted towards the lower end of the drill string. After drilling to a predetermined depth, the drill string and drill bit are removed and a section of casing is lowered into the wellbore. An annulus is thus formed between the string of casing and the formation. The casing string is cemented into the wellbore by circulating cement into the annulus defined between the outer wall of the casing and the borehole. The combination of cement and casing strengthens the wellbore and facilitates the isolation of certain areas of the formation behind the casing for the production of hydrocarbons.

It is common to employ more than one string of casing or liner in a wellbore. In this respect, the well is drilled to a first designated depth with a drill bit on a drill string. The drill string is removed. A first string of casing is then run into the wellbore and set in the drilled out portion of the wellbore, and cement is circulated into the annulus behind the casing string. Next, the well is drilled to a second designated depth, and a second string of casing or liner, is run into the drilled out portion of the wellbore. If the second string is a liner string, the liner is set at a depth such that the upper portion of the second string of casing overlaps the lower portion of the first string of casing. The liner string may then be hung off of the existing casing. The second casing or liner string is then cemented. This process is typically repeated with additional casing or liner strings until the well has been drilled to total depth. In this manner, wells are typically formed with two or more strings of casing/liner of an ever-decreasing diameter.

Stage cementing operations may be utilized to isolate producing zones from migrating water or other well fluids from other levels. Such cementing operations often occur along the length of the casing string after primary cementing of the lower portion of the casing string.

After cementing, it is desirable to remove the internal operating parts of a stage cementing tool so further downhole operations may be performed. The internal operating parts are typically removed by drill out. The process of drilling out the stage cementing tool requires run in of a drill string and most likely, a drilling rig for operating the drill string.

There is, therefore, a need for an improved apparatus and method of performing a stage cementing operation that does not require drill out of the internal operating parts of the stage tool.

SUMMARY

In one embodiment, a flow control apparatus includes a housing having a bore extending and a port formed through a wall of the housing; a port sleeve disposed in the housing and having a port in communication with the port of the housing; a first sleeve releasably attached to the housing, wherein the first sleeve is movable from a first position preventing axial movement of the port sleeve relative to the housing to a second position allowing axial movement of the port sleeve relative to the housing; and a second sleeve releasably attached to the port sleeve, wherein the second sleeve is movable from a first position blocking fluid communication through the port of housing and the port of the port sleeve to a second position allowing fluid communication through the ports.

In one embodiment, a downhole tool assembly includes a flow control device, a packer; and a float collar assembly. The flow control device includes a housing having a bore extending and a port formed through a wall of the housing; a port sleeve disposed in the housing and having a port in fluid communication with the port of the housing; a first sleeve releasably attached to the housing, wherein the first sleeve is movable from a first position preventing axial movement of the port sleeve relative to the housing to a second position allowing axial movement of the port sleeve relative to the housing; and a second sleeve releasably attached to the port sleeve, wherein the second sleeve is movable from a first position blocking fluid communication through the port of housing and the port of the port sleeve to a second position allowing fluid communication through the ports.

In another embodiment, a method of operating a flow control device in a wellbore includes positioning the flow control device in the wellbore, the flow control device having a housing having a bore extending and a port formed through a sidewall; a port sleeve having a port in communication with the port of the housing; a first sleeve releasably attached to the housing and preventing axial movement of the port sleeve relative to the housing; and a second sleeve releasably attached to the port sleeve and blocking fluid communication through the port of housing and the port of the port sleeve. The method further includes releasing the second sleeve from the port sleeve, thereby allowing fluid communication through the port of the housing and the port of the port sleeve; releasing the first sleeve from the housing, thereby allowing axial movement of the port sleeve relative to the housing; moving the port sleeve relative to the housing, thereby closing fluid communication between the port of the port sleeve and the port of the housing; and moving the first sleeve and the second sleeve out of the housing.

In one embodiment, a method of supplying fluid into a wellbore includes blocking fluid communication through a float collar assembly; actuating a packer to seal an annular area between the wellbore and a tubular string; and opening a port in a flow control device for fluid communication with the annular area. The flow control device includes a housing having a bore extending and the port formed through a sidewall; a port sleeve having a port in fluid communication with the port of the housing; a first sleeve releasably attached to the housing; and a second sleeve releasably attached to the port sleeve, and wherein opening the port includes releasing the second sleeve from the port sleeve. The method also includes supplying fluid into the bore and out of the port of the port sleeve and the port of the housing; releasing the first sleeve from the housing, thereby allowing axial movement of the port sleeve relative to the housing; closing the port of the housing by moving the port sleeve relative to the housing; and moving the first sleeve and the second sleeve out of the housing.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION

Figure 1:
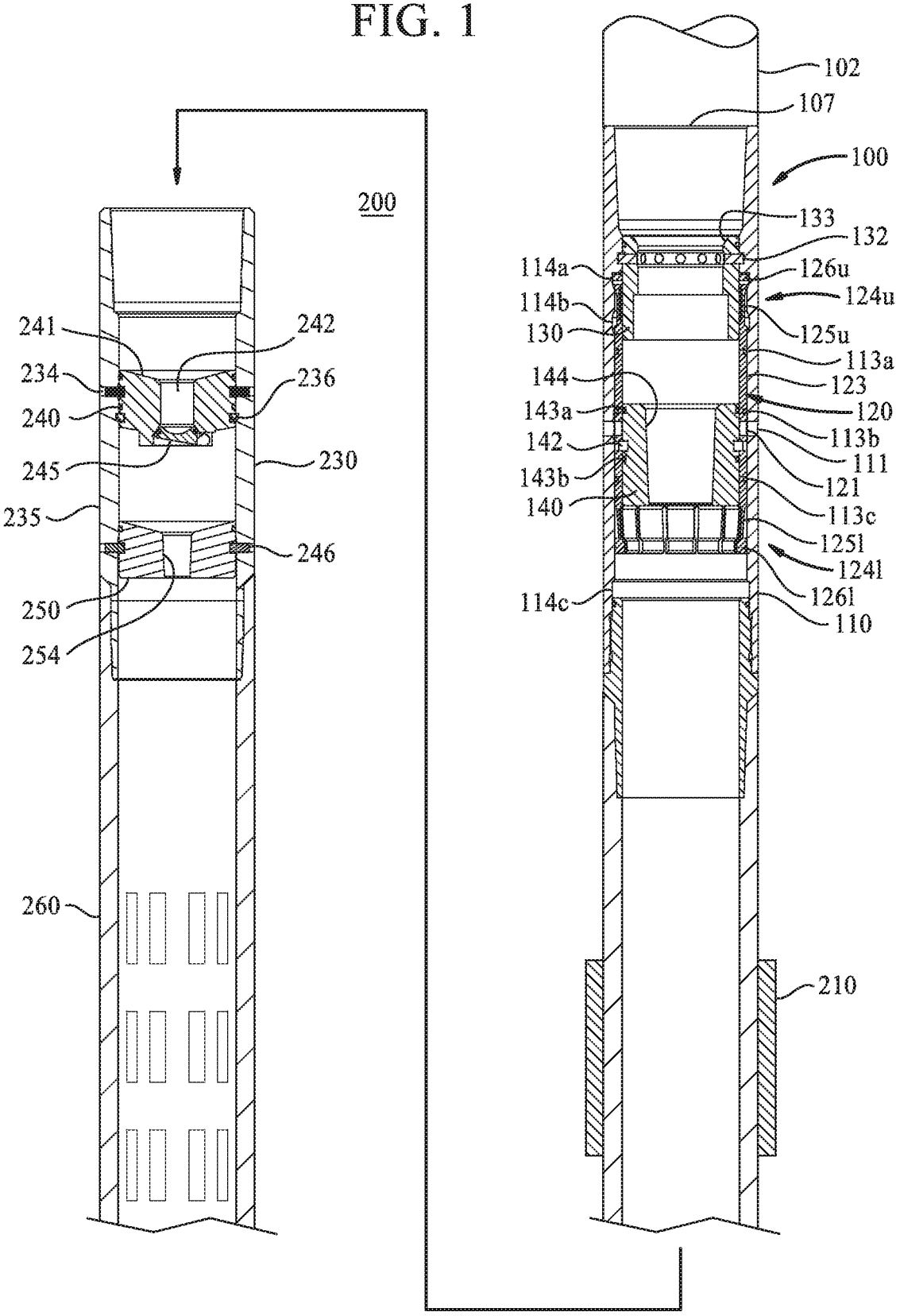
FIG. 1 illustrate an exemplary bottom hole assembly having a stage tool according to embodiments of the present disclosure.

FIG. 1 illustrate an embodiment of a flow control device such as a stage tool 100 disposed in an exemplary bottom hole assembly 200. The stage tool 100 is located above an annular packer 210, which is located above a float collar assembly 230. A screen or slotted casing joints 260 are connected below the float collar assembly 230. One or more pup joints, such as casing joints, may be included in the bottom hole assembly 200 and disposed between different components of the bottom hole assembly 200, such as between the stage tool 100 and the annular packer 210 or between the annular packer 210 and the float collar assembly 230. While a screen 260, such as a sand screen, is shown, it is contemplated that a non-perforated tubular or tubular string may be attached below the float collar assembly 230. One or more components of the bottom hole assembly 200, such as the screen 260, may be located adjacent an open hole section of the wellbore.

In one embodiment, the stage tool 100 includes a tubular housing 110 having a bore 107 extending therethrough. One or more ports 111 are formed through the wall of the housing for fluid communication with an exterior of the stage tool, e.g., an annular area between the housing and the wall of the wellbore. A port sleeve 120 is disposed in a recessed area of the inner wall of the housing 110. The port sleeve 120 includes a sleeve body 123 having one or more ports 121 aligned with the ports 111 of the housing 110. Seals 113*a*, 113*c* may be provided between the housing 110 and the sleeve 120 and straddling the ports 111, 121 to prevent leakage. As shown, seal 113*b* is not engaged with the housing 110 due to a recess formed in the wall of the housing 110 to prevent engagement with the seal 113*b*. In another embodiment, the ports 121 of the port sleeve 120 and the ports 111 of the housing 110 are not aligned but are in fluid communication. The port sleeve 120 also includes an upper collet 124*u* and a lower collet 124*l* disposed at the upper and lower ends of the sleeve body 123, respectively. Each of the collets 124*u* 124*l* includes a plurality of fingers 125*u*, 125*l* and a collet head 126*u*, 126*l* at the end of each finger 125*u*, 125*l*. The collet head 126*u*, 126*l* includes a shoulder that is larger than the finger 125*u*, 125*l*. As shown in FIG. 1, the heads 126*u* of the upper collet 124*u* are disposed in groove 114*a* formed in the wall of the sleeve body 110, and thus, the fingers 125*u* are in the extended position. Because the heads 126*l* of the lower collet 124*l* are not disposed in a groove, the fingers 126*l* of the lower collet 124*l* are compressed inward.

An upper sleeve 130 is used to retain the upper collet 124*u* in its position. The upper sleeve 130 is positioned adjacent the heads 126*u* of the upper collet 124*u* to prevent the heads 126*u* from moving out of the groove 114*a*. In one embodiment, the upper sleeve 130 is attached to the housing 110 using one or more shearable members such as shear pins 132. A seal may be provided between the upper sleeve 130 and the housing 110 to prevent fluid communication therebetween. The upper sleeve 130 is configured to receive a released object such as a dart, ball, or plug, which may be used to release the upper sleeve 130 from the housing 110. In one embodiment, the upper sleeve 130 is provided with a seat 133 at an upper end to receive the released object.

A lower sleeve 140 is used to prevent fluid communication through the ports 111, 121 during run-in. Seals 143*a*, 143*b* may be provided between the lower sleeve 140 and the port sleeve 120 and straddling the ports 121 to prevent leakage. In one embodiment, the lower sleeve 140 is attached to the port sleeve 120 using one or more shearable members such as shear pins 142. The lower sleeve 140 is configured to receive a released object, such as a dart, ball, or plug, that passes through the upper sleeve 130. In one example, the lower sleeve 140 includes a seat 144 configured with a locking taper design to receive a ball. The locking taper design may prevent the ball from shifting upward or downward.

The float collar assembly 230 is connected below the stage tool 100. In one embodiment, the float collar assembly 230 includes a housing 235, a valve 240, and a seat sleeve 250. The upper and lower ends of the housing 235 are configured to the attach to components of the bottom hole assembly 200, such as the stage tool 100, screen 260, and pup joints. The valve 240 is releasably attached to the housing 235 using one or more shearable members such as shear pins 234. In one embodiment, a lock ring such as a snap ring 236 may be used in addition to or instead of the shearable member. The snap ring 236 is configured to require more force to be applied from below to release the valve 240 than force applied from above the valve 240. In one example, the snap ring 236 includes a square shoulder on the top side and a taper bottom side. In this example, the valve 240 is a flapper valve. However, the valve 240 may be any suitable one way valve. The valve 240 includes a valve body 241 and a bore 242 extending therethough. A flapper 245 is pivotally coupled to the valve body 241 and used to close the bore 242. The flapper 245 may be biased in the upward position to close the bore 242 using a biasing member such as a spring.

The seat sleeve 250 is positioned below the valve 240 and releasably attached to the housing 235 using one or more shearable members such as shear pins 246. In one embodiment, the seat sleeve 250 is configured to receive a released object, such as a dart, ball, or plug, that passes through the valve 240. In one example, the seal sleeve 250 includes a seat 254 configured with a locking taper design to receive a ball. The locking taper design may prevent the ball from shifting upward or downward.

Figure 2:
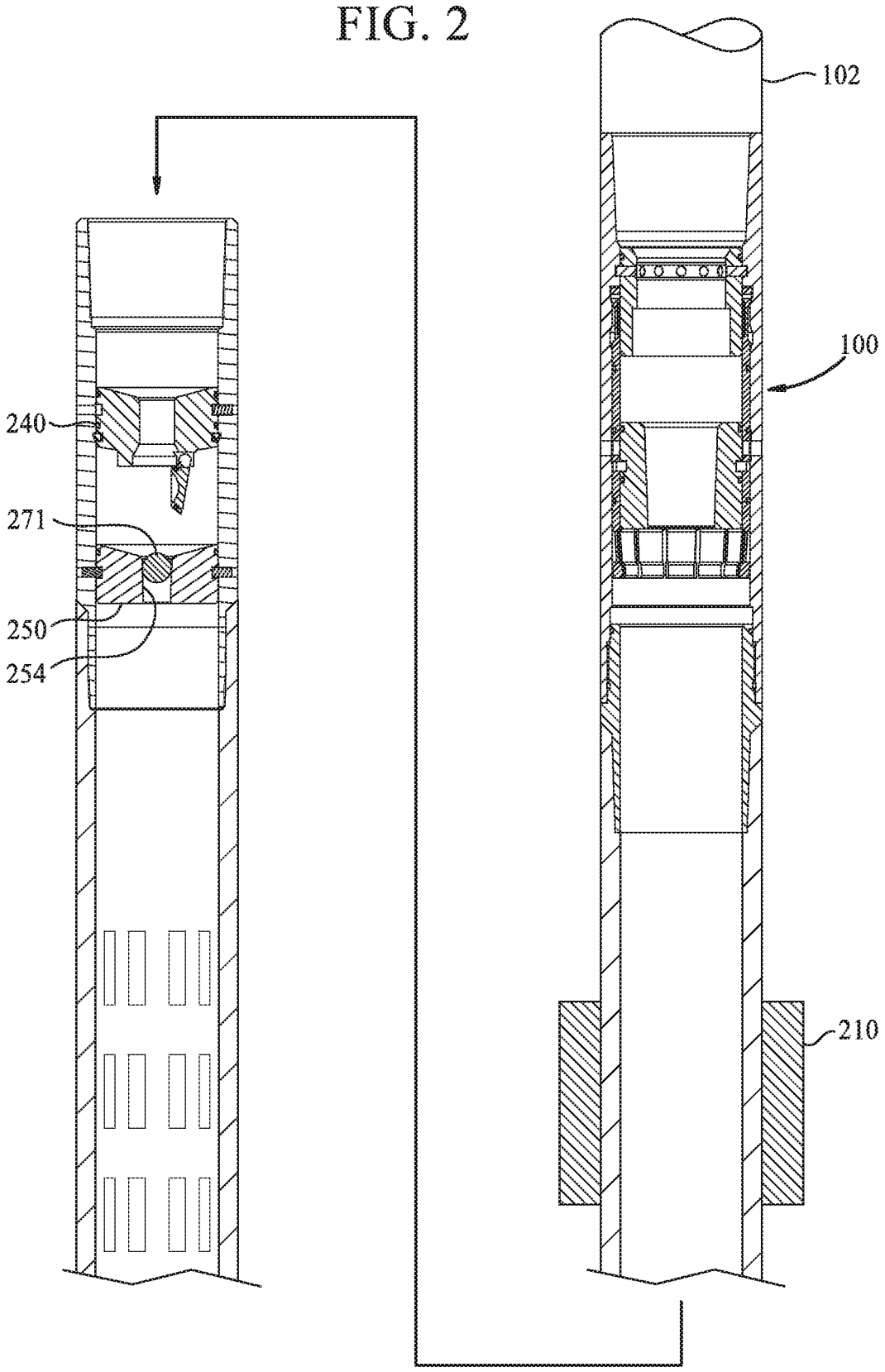
FIGS. 2-11 illustrates an exemplary operation sequence of the bottom hole assembly of FIG. 1.

Referring to FIG. 2, in operation, a casing string 102 having a bottom hole assembly 200 is lowered into the wellbore to isolate a section of the wellbore. In one example, the bottom hole assembly 200 is positioned in an open hole section of the wellbore. A cementing operation is performed after the bottom hole assembly 200 is positioned in the desired location.

The cementing operation begins by releasing a first ball 271 into the casing string 102. The first ball 271 moves past the stage tool 100 and the flapper valve 240 and lands in the seat 254 of the seat sleeve 250. The first ball 271 blocks fluid communication through the seat sleeve 250. Pressure in the casing string 102 is increases sufficiently to actuate the annular packer 210. The annular packer 210 is expanded into contact with the wellbore wall. Optionally, a pressure test is performed to test the casing string 210.

Figure 3:
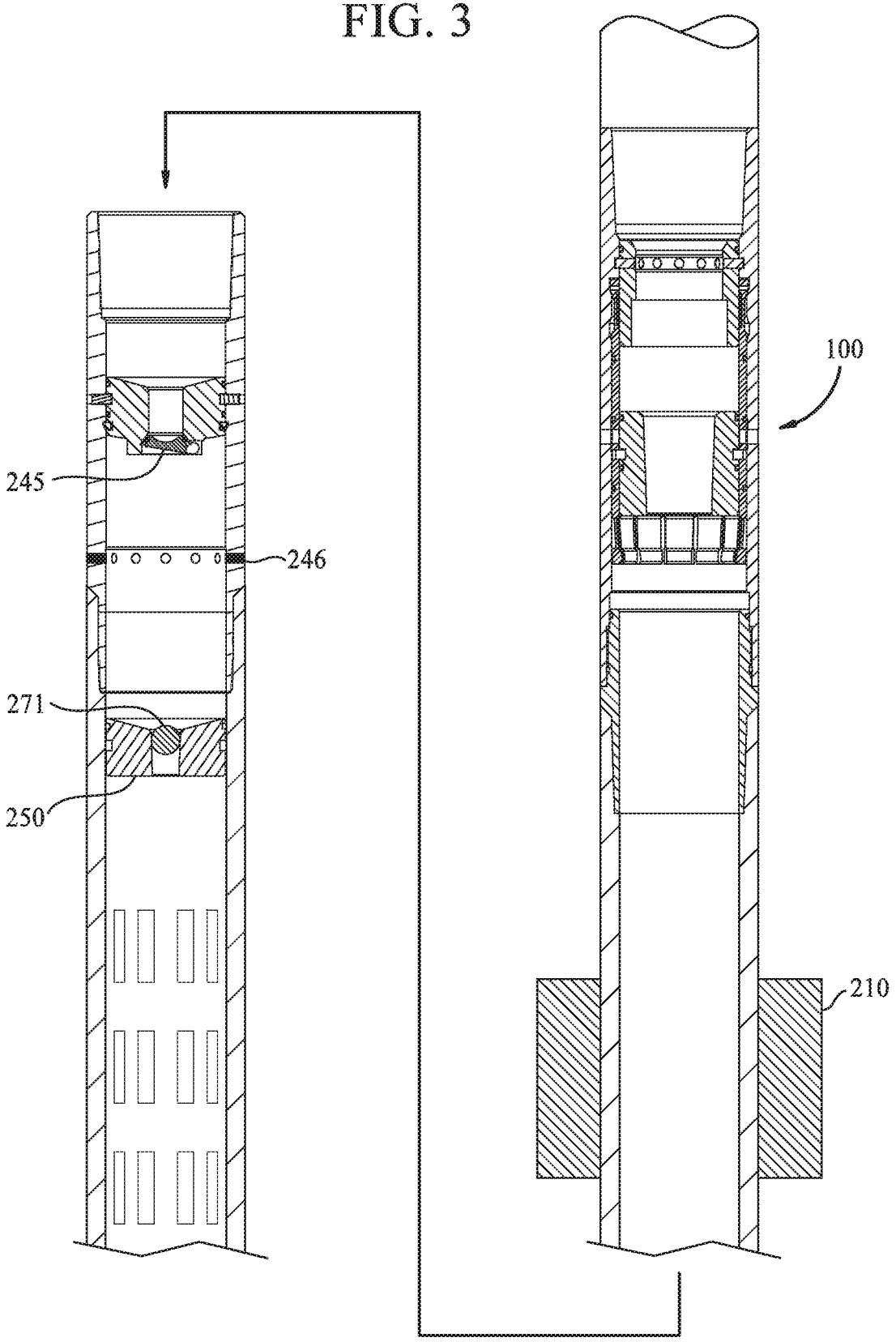

Referring to FIG. 3, after testing, pressure is increased further to shear the shear pins 246, thereby releasing the seat sleeve 250 and the first ball 271 from the housing 235 of the float collar 230. After releasing the seat sleeve 250, the flapper 245 closes. Optionally, fluid may be circulated in the wellbore.

Figure 4:
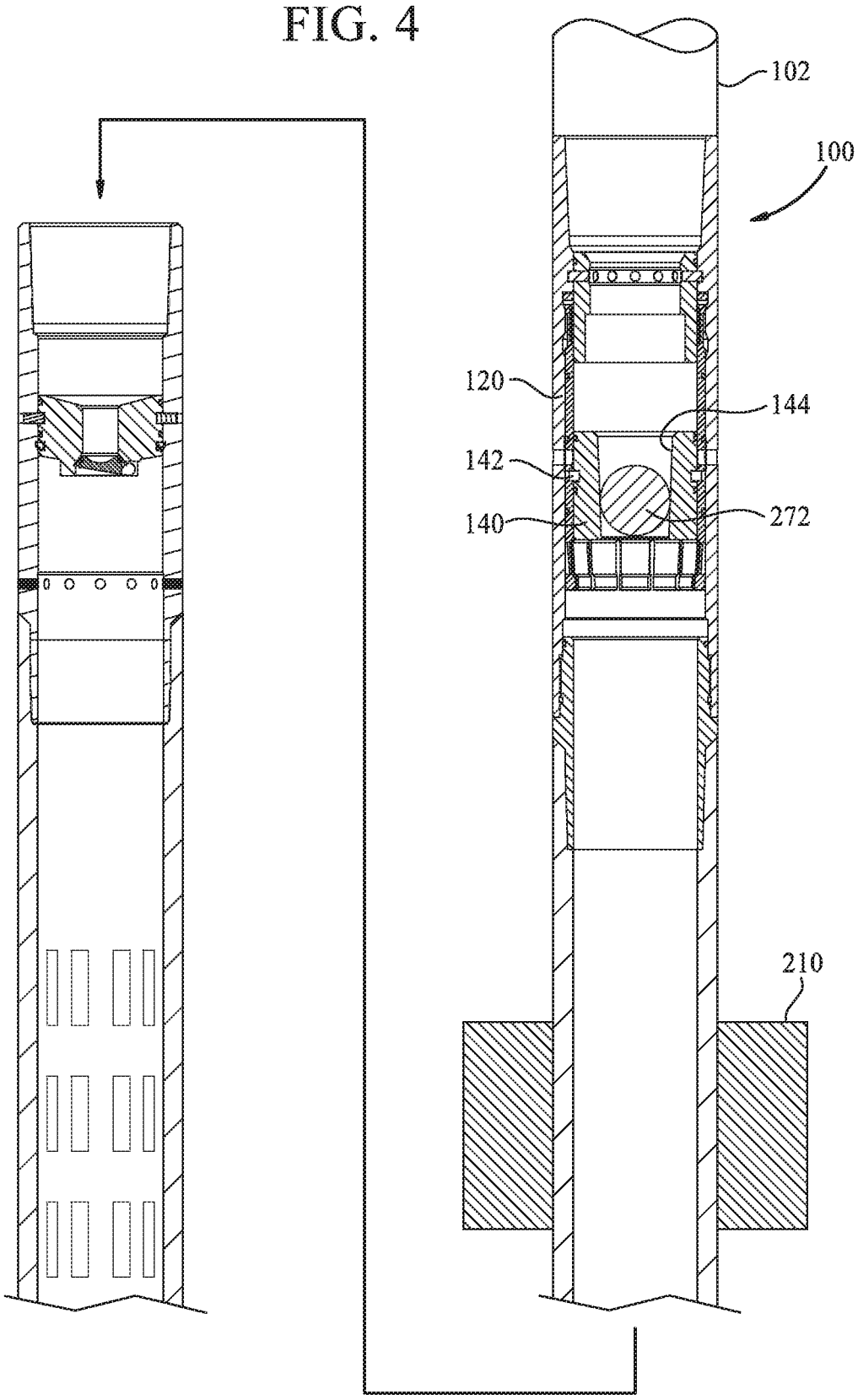

In FIG. 4, a second ball 272 is released into the casing string 102 and lands in the seat 144 of the lower sleeve 140. For sake of clarity, FIG. 4 only shows the stage tool 100 of the bottom hole assembly 200. The second ball 272 is larger than the first ball 271. The second ball 272 blocks fluid communication through the stage tool 100. Pressure is increased sufficiently to shear the shear pins 142 retaining the lower sleeve 140 against the port sleeve 120.

Figure 5:
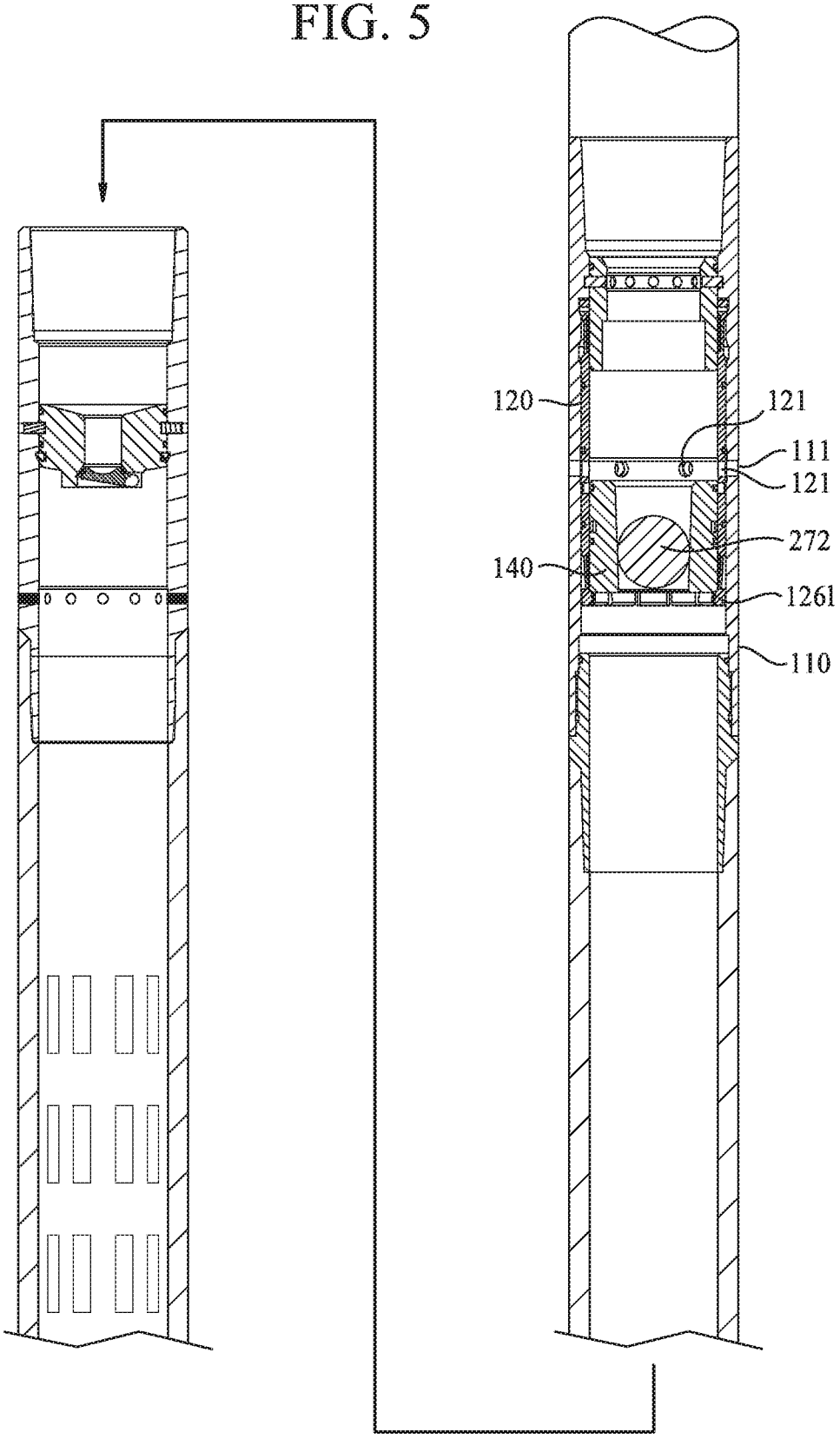

After release from the shear pins 142, the lower sleeve 140 will move downward relative to the port sleeve 120, as shown in FIG. 5. Downward movement of the lower sleeve 140 is stopped when it abuts against the lower collet heads **126*l*. The lower sleeve 140 is moved away from the ports 121 so that it is no longer blocking the ports 121, thereby opening the ports 111, 121 for fluid communication. Optionally, fluid may be circulated in the wellbore via the ports 111, 121 prior to supplying cement. Cement is supplied down the casing string 102 and flows out of the stage tool 100 via the ports 111, 121. The annulus packer 210** acts a lower limit of the cement in the annulus. The cement may also flow upward in the annulus to a level above the stage tool.

Figure 6:
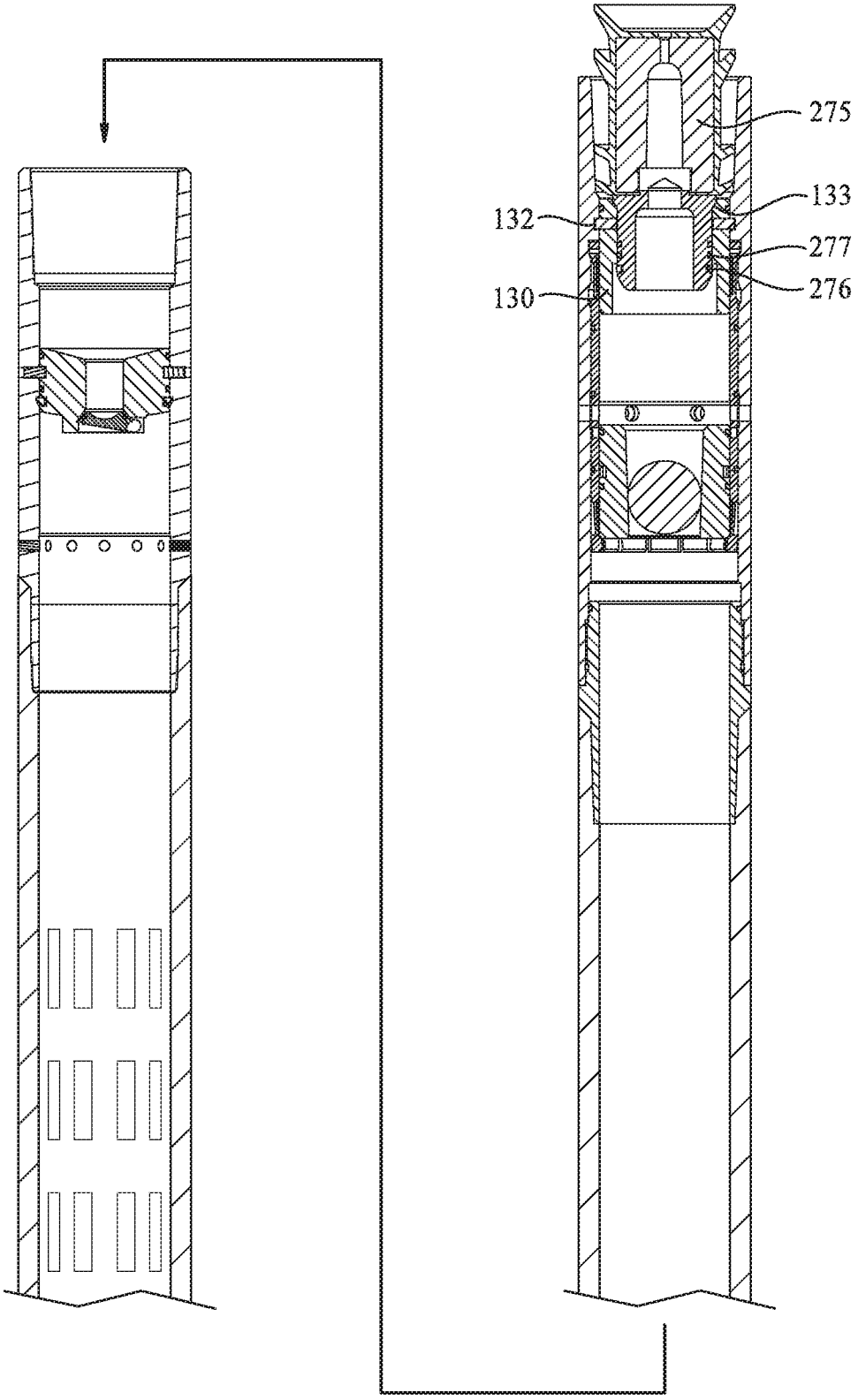

A plug 275 is released behind the cement after the desired amount of cement has been supplied into the casing string 102. In FIG. 6, the plug 275 lands on the seat 133 of the upper sleeve 130 and latches to the upper sleeve 130. As shown, the plug 275 includes an outward shoulder that has engaged the seat 133 and a snap ring 276 that has latched against an inner shoulder of the upper sleeve 130. The plug 275 also includes one or more seals 277 engaged with the upper sleeve 130. Pressure is increased sufficiently to shear the shear pins 132 retaining the upper sleeve 130 against the housing 110.

Figure 7:
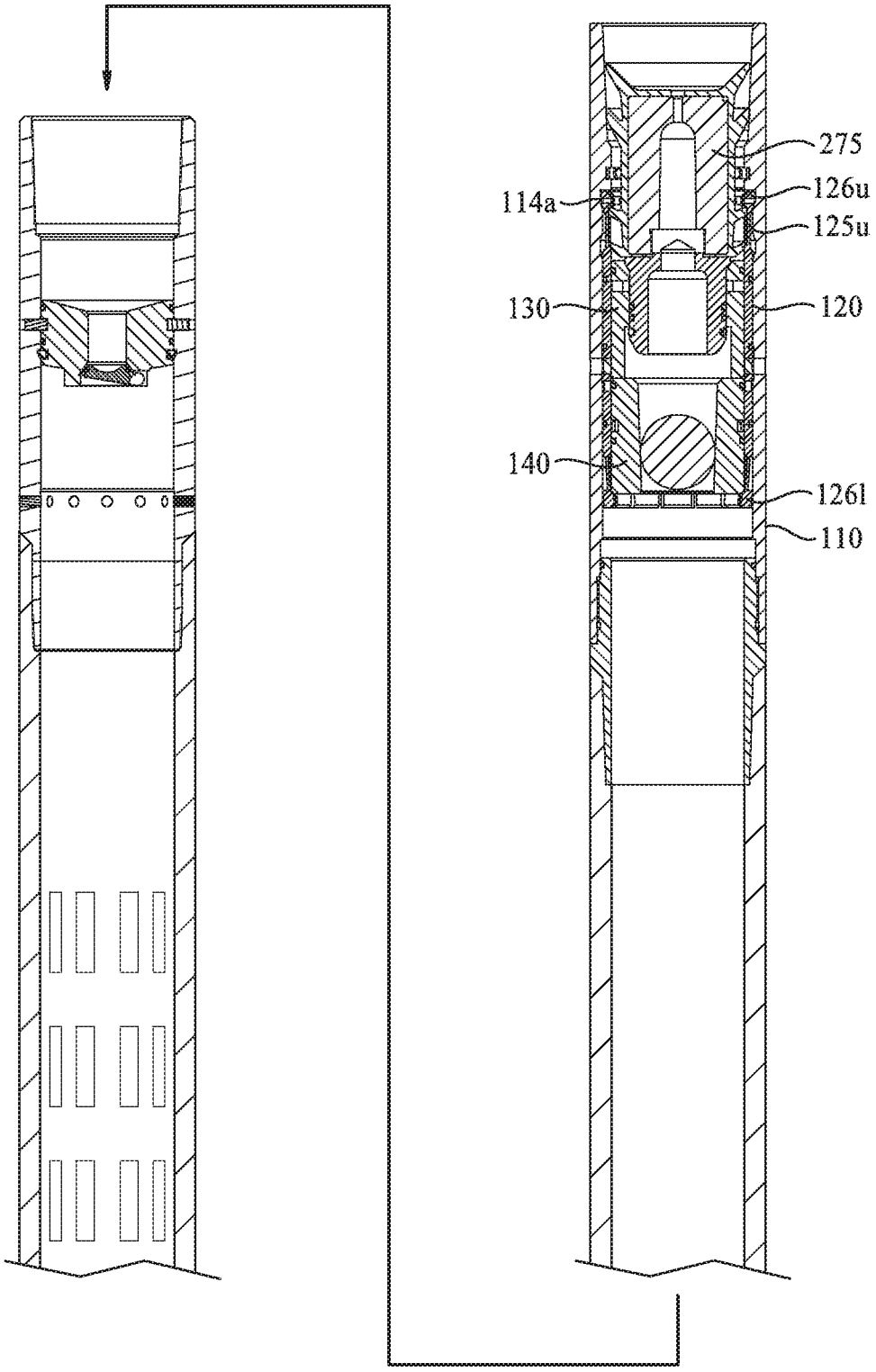

After release from the shear pins 132, the upper sleeve 130 moves downward relative to the housing 110, as shown in FIG. 7. Downward movement of the upper sleeve 130 is stopped when it abuts against the upper sleeve 140. As shown in FIG. 7, downward movement of the upper sleeve 130 also frees the upper collet heads **126*u* of the upper collet fingers 125*u* from the groove 114*a*, which allows movement of the collet heads 126*u* relative to the groove 114*a***.

Figure 8:
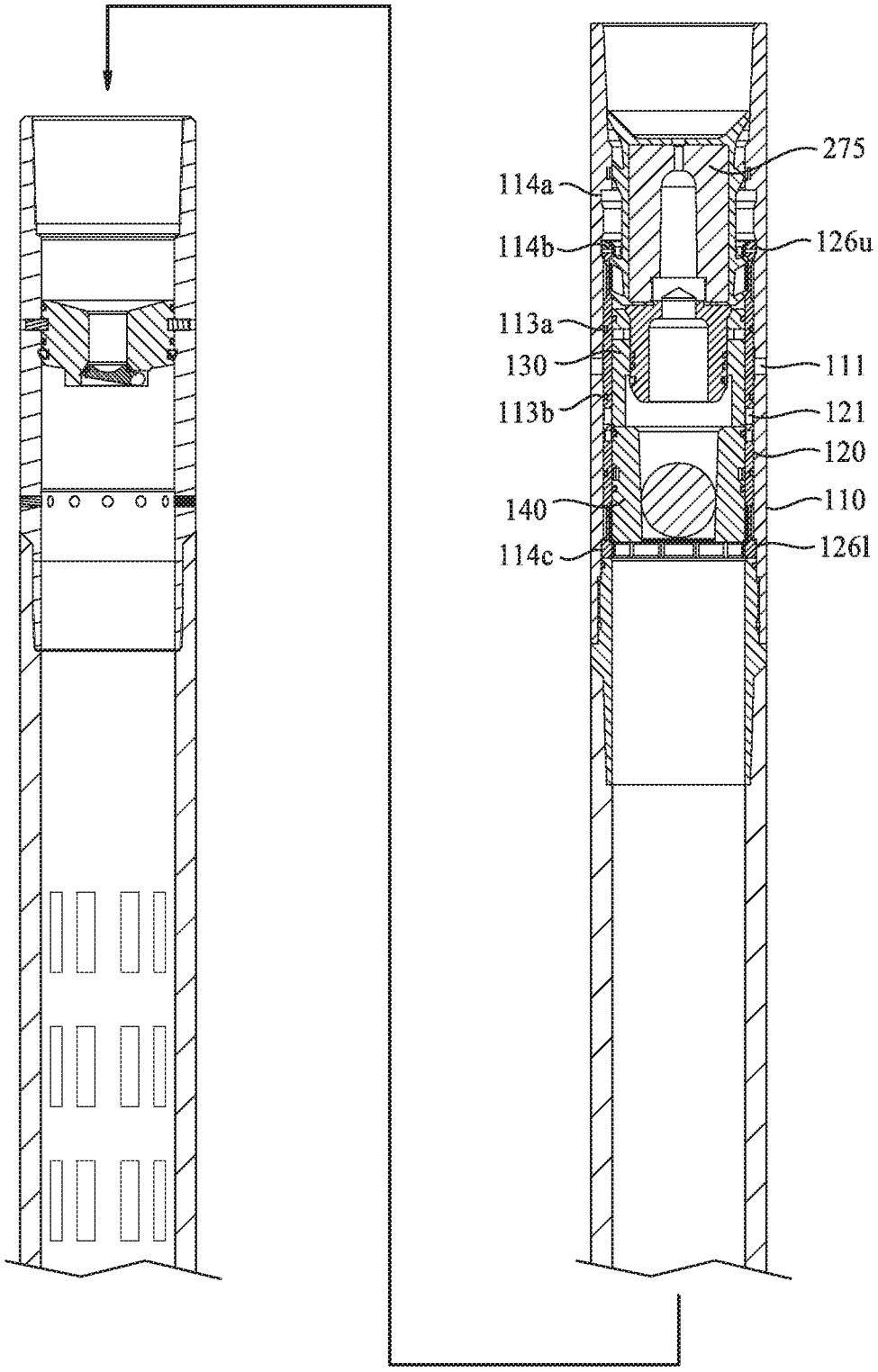

Pressure above the plug 275 urges the upper sleeve 130 and the lower sleeve 140 downward. In turn, the lower sleeve 140 applies a downward force against the lower collet heads **276*l* to urge the port sleeve 120 downward. As shown in FIG. 8, the port sleeve 120 has moved downward relative to the housing 110. As a result, the ports 121 of the port sleeve 120 are moved out of alignment with ports 111 of the housing 110, thereby closing fluid communication through the ports 111 of the housing 110 into the annulus. Seals 113*a*, 113*b* may be provided between the housing 110 and the sleeve 120 and straddling the ports 111 to prevent leakage. In particular, seal 113*b* has moved away from the recess and is in contact with the wall of the housing 110. The upper collet heads 126*u* have released from groove 114*a* and engaged with a lower groove 114*b*. The lower collet heads 126*l* have engaged a groove 143*c* in the housing 110 and are prevented from further downward movement or upward movement. Because the lower collet heads 126*l* flexed outward to engage the groove 114*c*, the lower collet heads 126*l* no longer support the bottom of the lower sleeve 140. As a result, the lower sleeve 140, the ball 272, the upper sleeve 130, and the plug 275 are allowed to move downward relative to the housing 110**.

Figure 9:
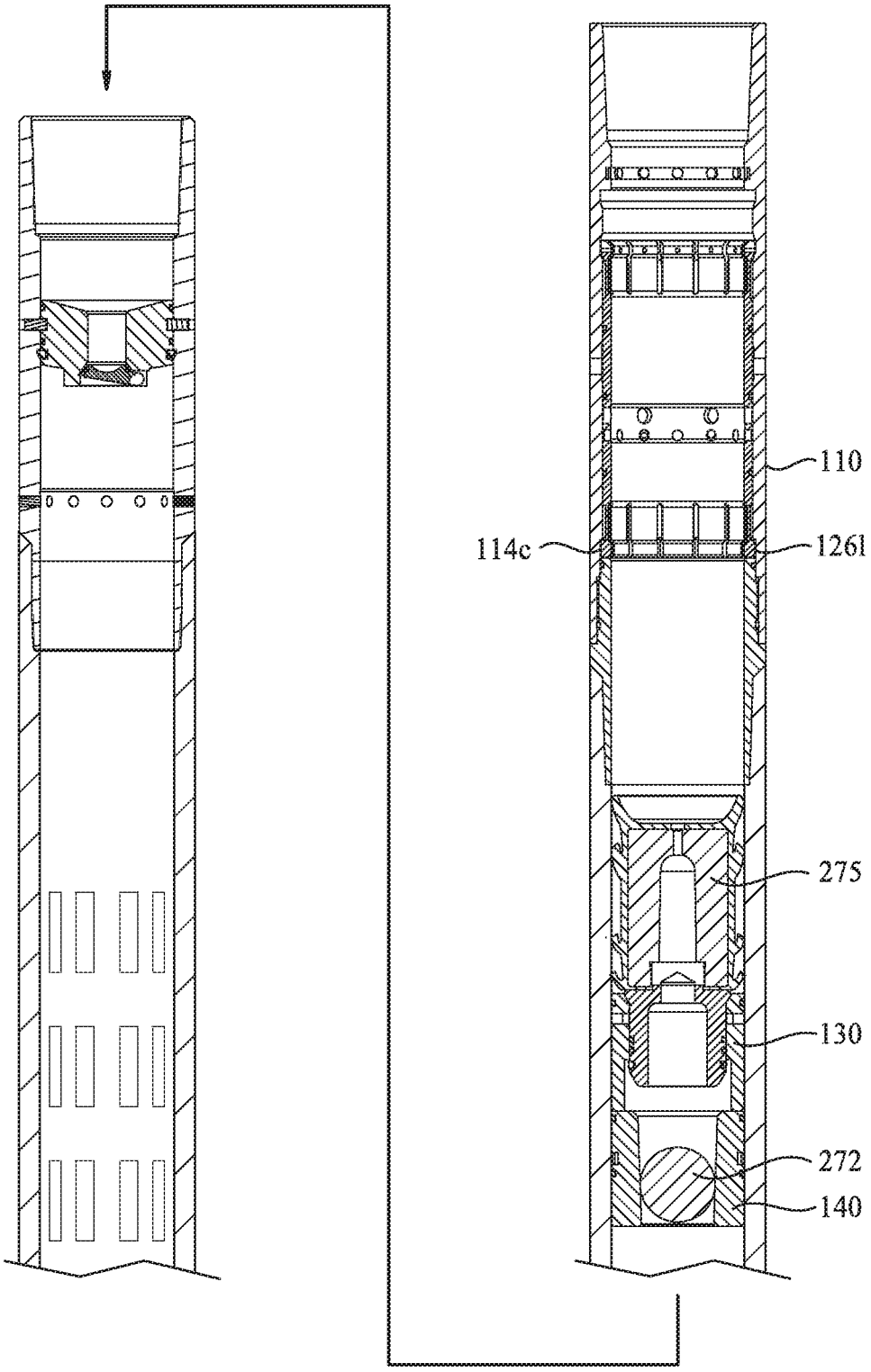

In FIG. 9, the lower sleeve 140, the ball 272, the upper sleeve 130, and the plug 275 have been pumped out of the stage tool 100. The stage tool 100 has gained full bore access.

Figure 10:
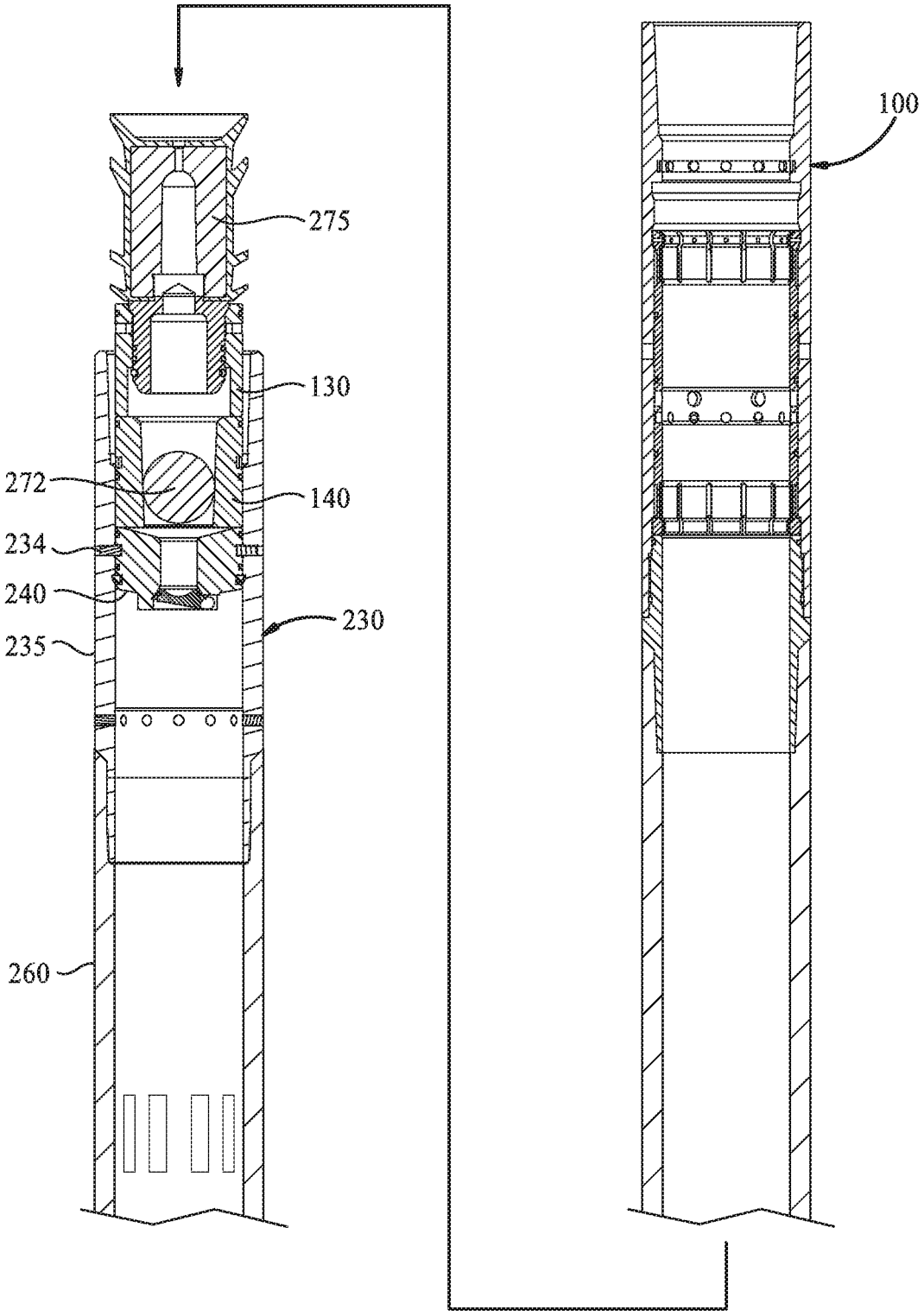

The lower sleeve 140, the ball 272, the upper sleeve 130, and the plug 275 continue to move downward until they land on the valve 240 of the float collar assembly 230, as shown in FIG. 10. Pressure is increased sufficiently to shear the shear pins 234 retaining the valve 240 against the housing 235 of the float collar assembly 230.

Figure 11:
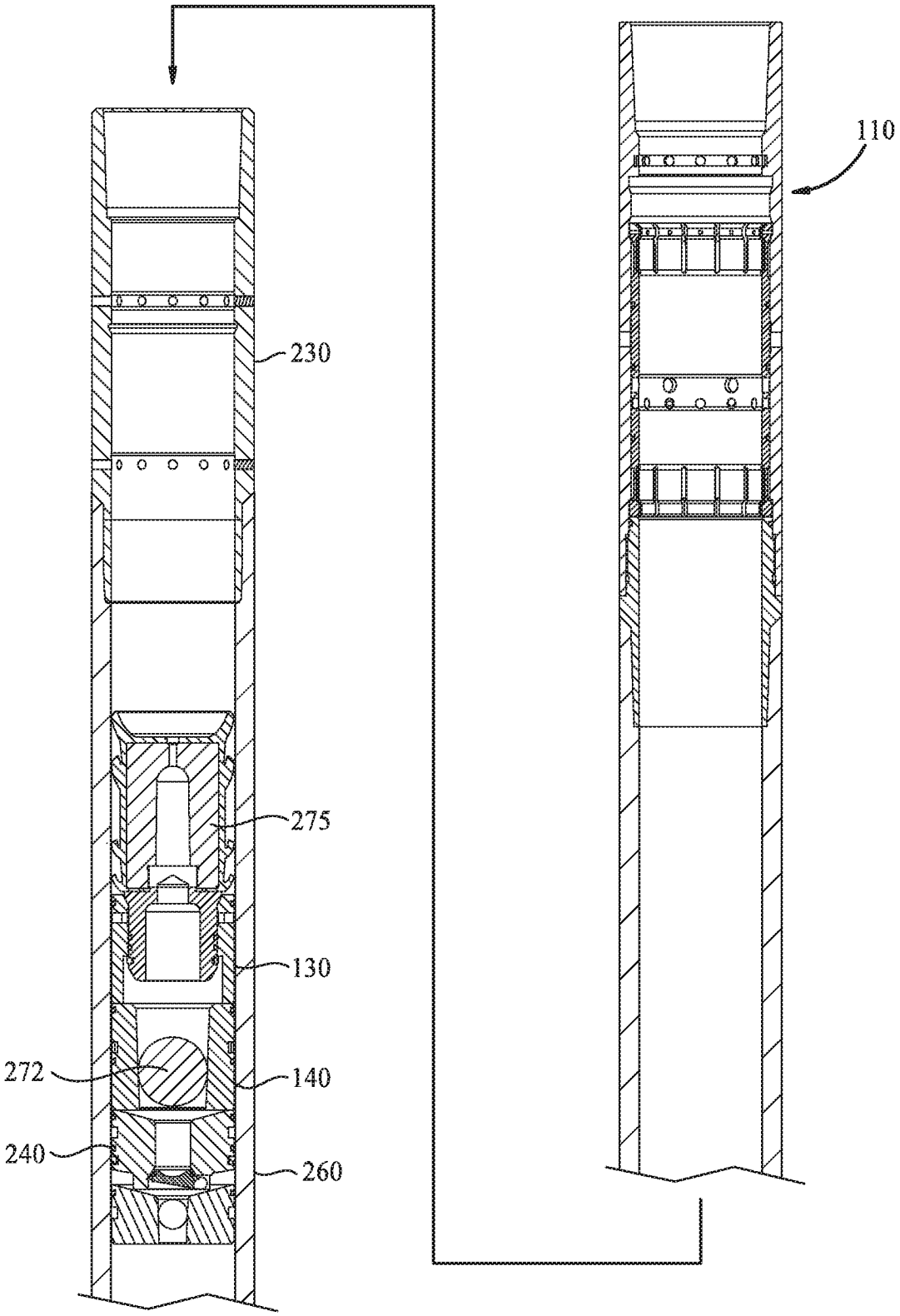

In FIG. 11, the valve 240, the lower sleeve 140, the ball 272, the upper sleeve 130, and the plug 275 have been pumped out of the float collar assembly 230 and down to the screens or slotted casing 260. After reaching the screens or slotted casing, the valve 240, the lower sleeve 140, the ball 272, the upper sleeve 130, and the plug 275 are allowed to free fall to the bottom of the wellbore.

One advantage of embodiments of the present disclosure is the stage tool and the float collar assembly have inner diameters that are clean and clear components after the cementing operation. The full bore access is obtained without performing a drilling operation to remove one or more components of the stage tool and the float collar assembly. This advantage allows a stage cementing operation to be performed without the need of a rig, which may have significant cost savings to the operation.

Figure 12:
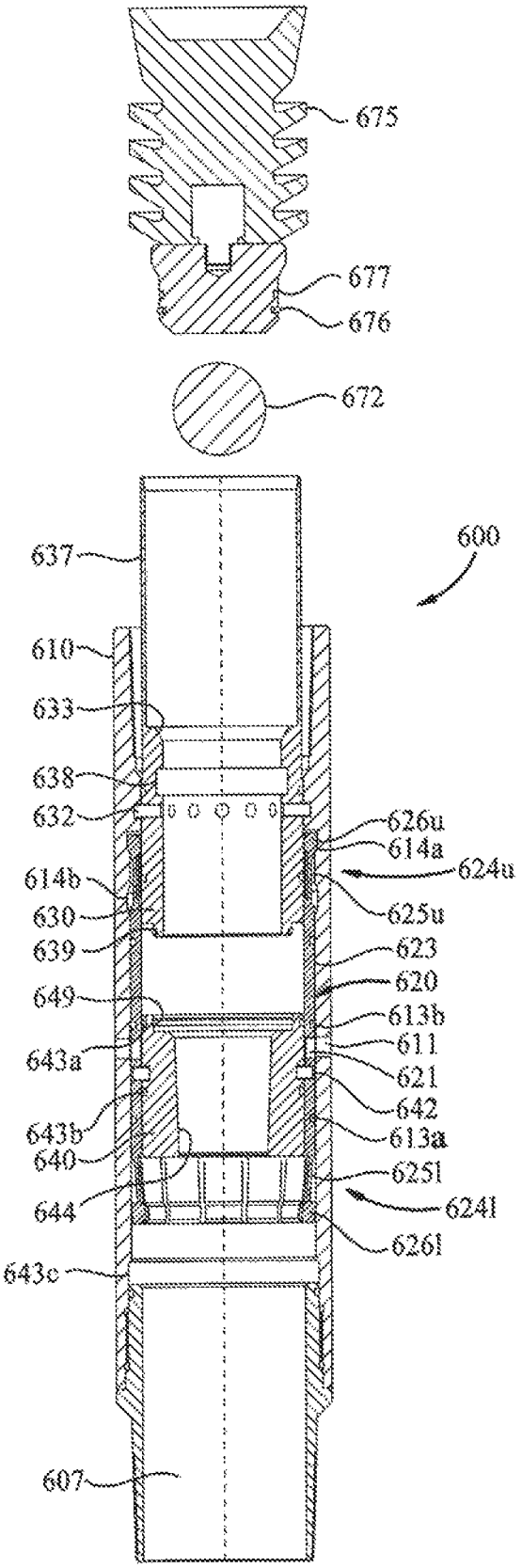
FIG. 12 shows another exemplary embodiment of a stage tool.

FIG. 12 illustrates another embodiment of a stage tool 600. The stage tool 600 may replace the stage tool 100 and used with the bottom hole assembly 200 or other suitable bottom hole assembly or casing string. In this embodiment, the stage tool 600 includes a tubular housing 610 having a bore 607 extending therethrough. One or more ports 611 are formed through the wall of the housing 610 for fluid communication with an exterior of the stage tool 600, e.g., an annular area between the housing and the wall of the wellbore.

A port sleeve 620 is disposed in a recessed area of the inner wall of the housing 610. The port sleeve 620 includes a sleeve body 623 having one or more ports 621 aligned with the ports 611 of the housing 610. Seals **613*a*, 613*b* may be provided between the housing 610 and the sleeve 620 and straddling the ports 611, 621 to prevent leakage. The port sleeve 620 also includes an upper collet 624*u* and a lower collet 624*l* disposed at the upper and lower ends of the sleeve body 623, respectively. Each of the collets 624*u*, 624*l* includes a plurality of fingers 625*u*, 625*l* and a collet head 626*u*, 626*l* at the end of each finger 625*u*, 625*l*. The collet head 626***u*, 626*l* includes a shoulder that is larger than the finger 625*u*, 625*l*. As shown in FIG. 12, the heads 626*u* of the upper collet 624*u* are disposed in groove 614*a* formed in the wall of the sleeve body 610, and thus, the fingers 625*u* are in the extended position. Because the heads 626*l* of the lower collet 624*l* are not disposed in a groove, the fingers 626*l* of the lower collet 624*l* are compressed inward.

An upper sleeve 630 is used to retain the upper collet 624*u* in its position. The upper sleeve 630 is positioned adjacent the heads 626*u* of the upper collet 624*u* to prevent the heads 626*u* from moving out of the groove 614*a*. In one embodiment, the upper sleeve 630 is attached to the housing 610 using one or more shearable members such as shear pins 632. The upper sleeve 630 is configured to receive a released object such as a dart, ball, or plug, which may be used to release the upper sleeve 630 from the housing 610. In one embodiment, the upper sleeve 630 is provided with a seat 633 at an upper end to receive the released object.

Figure 13:
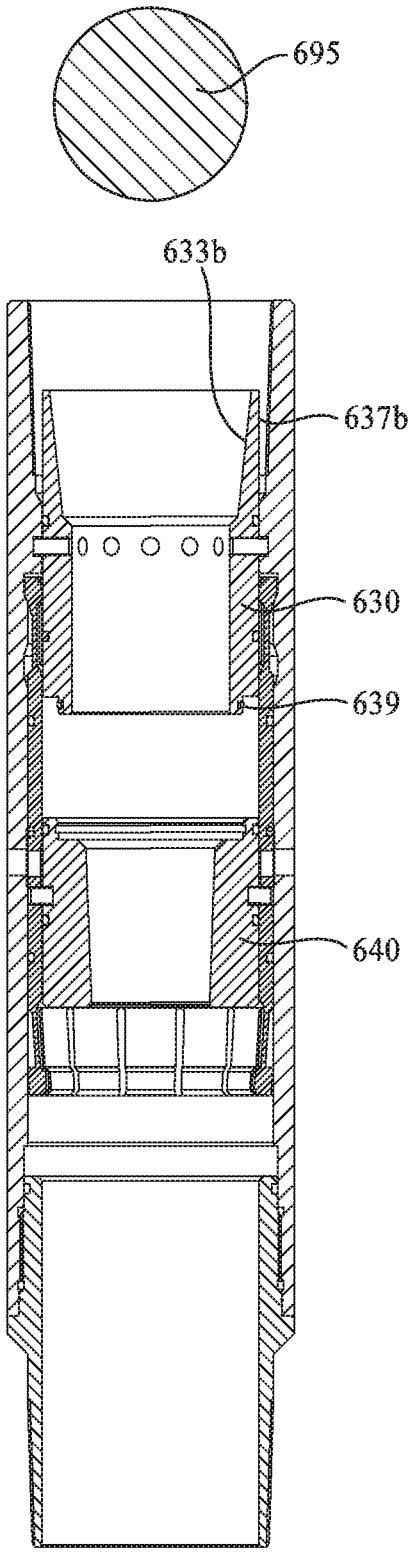
FIG. 13 shows another exemplary embodiment of a stage tool.

In one embodiment, as shown in FIG. 12, the seat 633 of the upper sleeve 630 is configured to receive a plug having one or more fins. The upper sleeve 630 includes a retainer portion 637 at an upper portion of the upper sleeve 630. In this example, the retainer portion 637 has sufficient length to retain one or more fins of the plug. In another example, as shown in FIG. 13, the upper sleeve 630 includes a seat 633*b* and a retainer portion 637*b*. The seat 633*b* of the upper sleeve 630 is configured to receive a ball. For example, the seat 633*b* may have a locking taper design to receive the ball.

Referring back to FIG. 12, a lower sleeve 640 is used to prevent fluid communication through the ports 611, 621 during run-in. Seals 643*a*, 643*b* may be provided between the lower sleeve 640 and the port sleeve 620 and straddling the ports 621 to prevent leakage. In one embodiment, the lower sleeve 640 is attached to the port sleeve 620 using one or more shearable members such as shear pins 642. The lower sleeve 640 is configured to receive a released object, such as a dart, ball, or plug, that passes through the upper sleeve 630. In one example, the lower sleeve 640 includes a seat 644 configured with a locking taper design to receive a ball. The locking taper design may prevent the ball from shifting upward or downward.

In one embodiment, the lower end of the upper sleeve 630 is configured to attach to the lower sleeve 640. In this embodiment, the lower end of the upper sleeve 630 is configured to latch into the lower sleeve 640. For example, the lower end of the upper sleeve 630 includes a snap ring 639 for engagement with a mating profile in the lower sleeve 640. An exemplary mating profile is a recessed groove 649. It must be noted the upper sleeve 630 may be attached to the lower sleeve 640 using any suitable mechanism, such as an interference fit, wedge connection, adhesives, spring lock balls or dogs, locking threads, and locking collets.

Figure 14:
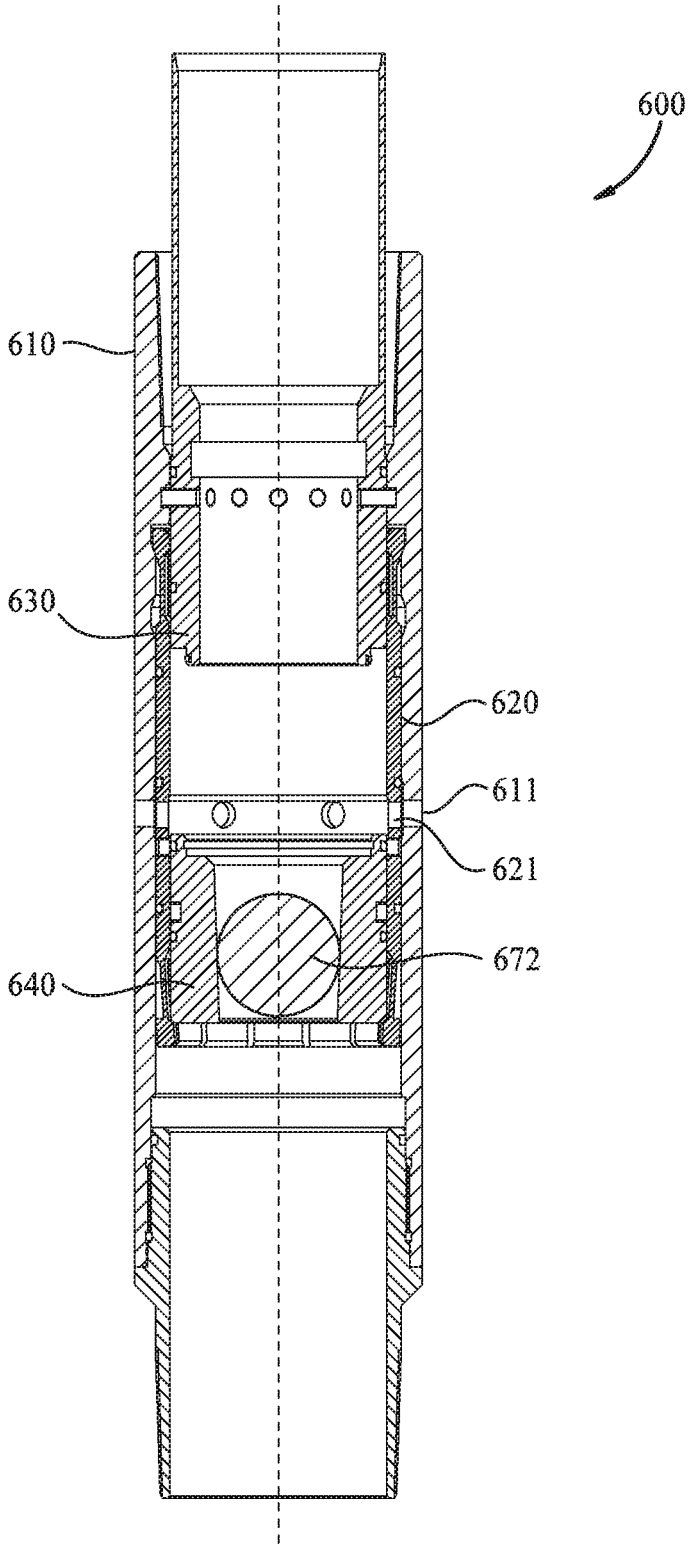
FIGS. 14-15 illustrates an exemplary operation sequence of the stage tool of FIG. 12.

In operation, a casing string 102 having a bottom hole assembly 200 equipped with the stage tool 600 is lowered into the wellbore to isolate a section of the wellbore. When it is desired to supply cement through the stage tool 600, a ball 672 is released into the casing string 102. Referring to FIG. 14, the ball 672 moves past the upper sleeve 630 and lands in the seat 644 of the lower sleeve 640. The ball 672 blocks fluid communication through the stage tool 600. Pressure is increased sufficiently to shear the shear pins 642 retaining the lower sleeve 640 against the port sleeve 620.

After release from the shear pins 642, the lower sleeve 640 will move downward relative to the port sleeve 620. Downward movement of the lower sleeve 640 is stopped when it abuts against the lower collet heads 626*l*. Downward movement of the lower sleeve 640 opens the ports 611, 621 for fluid communication, as shown in FIG. 14. Optionally, fluid may be circulated in the wellbore via the ports 611, 621. Cement is supplied down the casing string 102 and flows out of the stage tool 600 via the ports 611, 621. The annulus packer 210 acts a lower limit of the cement in the annulus. The cement may flow upward in the annulus to a level above the stage tool 600.

A plug 675 is released behind the cement after the desired amount of cement has been supplied into the casing string 102. The plug 675 lands on the seat 633 of the upper sleeve 630 and latches to the upper sleeve 630, thereby closing fluid communication through the upper sleeve 630. As shown, the plug 675 includes an outward shoulder that has engaged the seat 633 and a snap ring 676 that has latched against an inner shoulder 638 of the upper sleeve 630. The plug 675 also includes one or more seals 677 engaged with the upper sleeve 630. Pressure is increased sufficiently to shear the shear pins 632 retaining the upper sleeve 630 against the housing 610.

After release from the shear pins 632, the upper sleeve 630 moves downward relative to the housing 610. Downward movement of the upper sleeve 630 is stopped when it contacts the upper sleeve 640. The upper and lower sleeves 630, 640 are connected when the snap ring 639 at the lower end of the upper sleeve 630 engages with the recessed groove 649 in the lower sleeve 640. Downward movement of the upper sleeve 630 also frees the upper collet heads 626*u* of the upper collet fingers 625*u* from the groove 614*a*, which allows movement of the collet heads 626*u* relative to the groove 614*a*.

Figure 15:
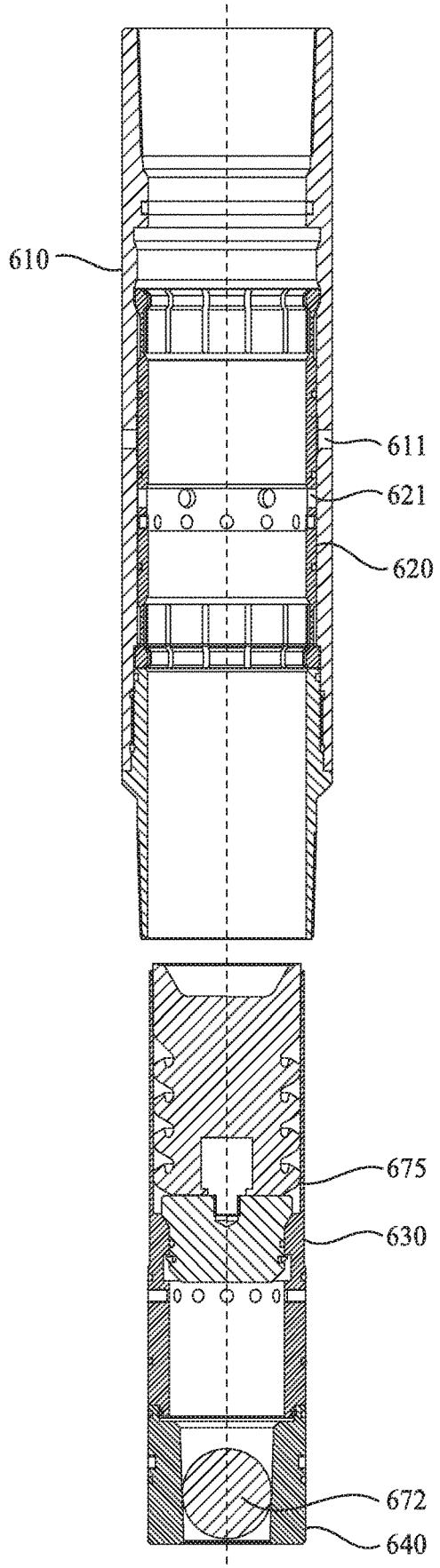

Pressure above the plug 675 urges the upper sleeve 630 and the lower sleeve 640 downward. In turn, the lower sleeve 640 applies a downward force against the lower collet heads 676*l* to urge the port sleeve 620 downward. As shown in FIG. 15, the port sleeve 620 has moved downward relative to the housing 610. As a result, the ports 621 of the port sleeve 620 are moved out of alignment with ports 611 of the housing 610, thereby closing fluid communication through the ports 611 of the housing 610. Seals 613*a*, 613*b* may be provided between the housing 610 and the sleeve 620 and straddling the ports 611 to prevent leakage. The upper collet heads 626*u* have moved down from groove 614*a* and engaged with a lower groove 614*b*. The lower collet heads 626*l* have engaged a groove 643*c* in the housing 610 and are prevented from further downward movement or upward movement. Because the lower collet heads 626*l* flexed outward to engage the groove 643*c*, the lower collet heads 626*l* no longer support the bottom of the lower sleeve 640. As a result, the lower sleeve 640, the upper sleeve 630, the ball 672, and the plug 675 are allowed to move downward relative to the housing 610.

In FIG. 15, the lower sleeve 640, the upper sleeve 630, the ball 672, and the plug 675 have been moved out of and below the housing 610 of the stage tool 600. The stage tool 600 has gained full bore access.

Figure 16:
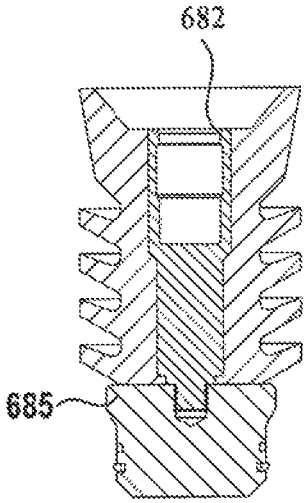
FIG. 16 illustrate an exemplary embodiment of a retrievable plug suitable for use with embodiments of stage tools described herein.
Figure 17:
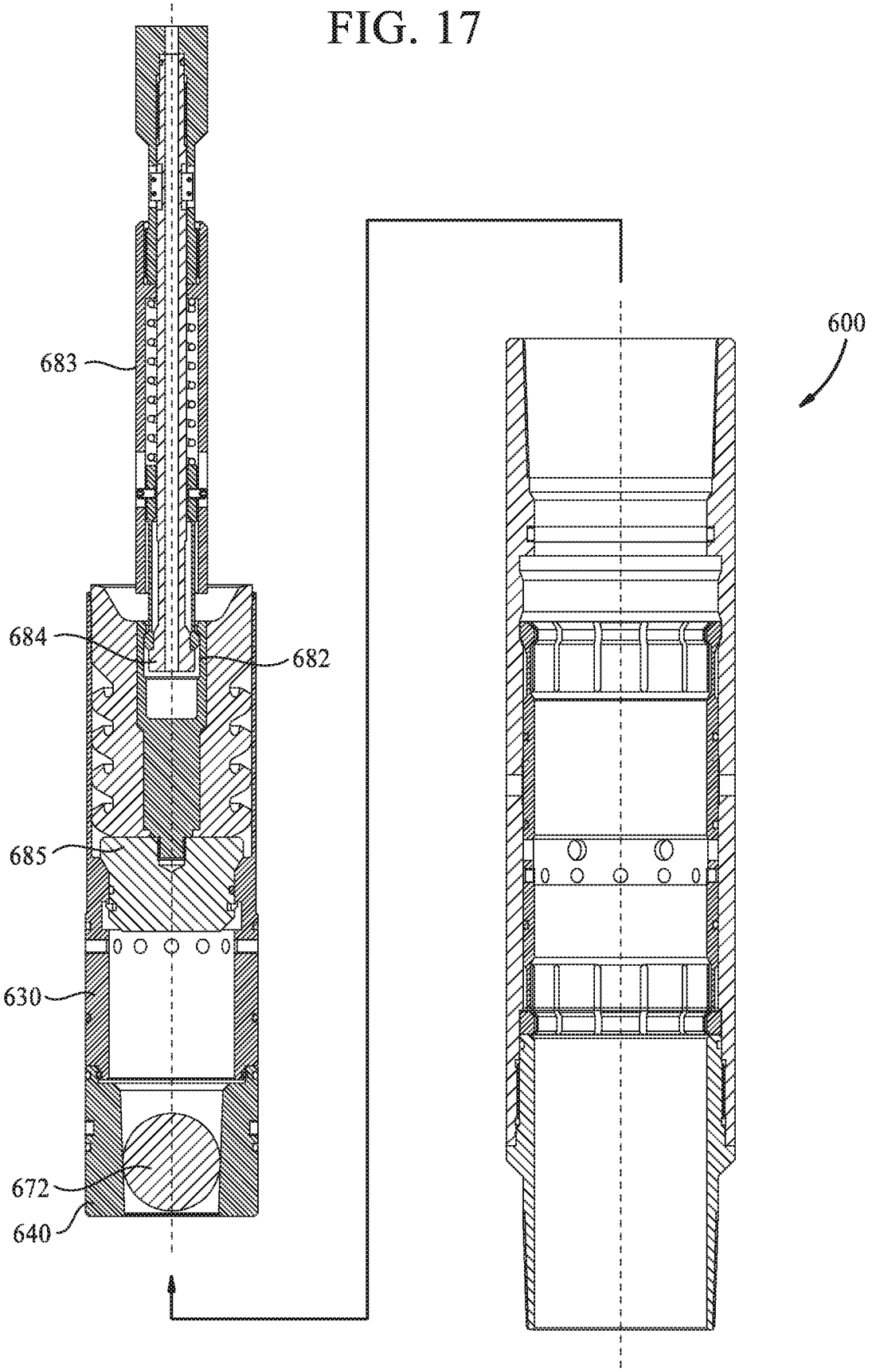
FIG. 17 illustrates the retrievable plug of FIG. 16 being retrieved.

In another embodiment, the lower sleeve 640, the upper sleeve 630, the ball 672, and the plug 675 are retrieved to surface instead of moving below the stage tool 600. In one example, the plug 685 may be equipped with a retrieval profile 682 for receiving a retrieval tool 683, as shown in FIGS. 16 and 17. The retrieval tool 683 includes a locking mechanism 684 such as dogs, collets, threads or other suitable locking mechanisms for engagement with the retrieval profile 682 of the plug 685. After moving the port sleeve 620 to close the ports 111, the retrieval tool 683 is lowered into the wellbore to engage the retrieval profile 682 of the plug 685. Because the plug 685 is latched to the upper sleeve 630, which is latched to the lower sleeve 640, the assembly of the plug 685, upper sleeve 630, the ball 672, and the lower sleeve 640 can be retrieved at the same time by the retrieval tool 683.

Figure 18:
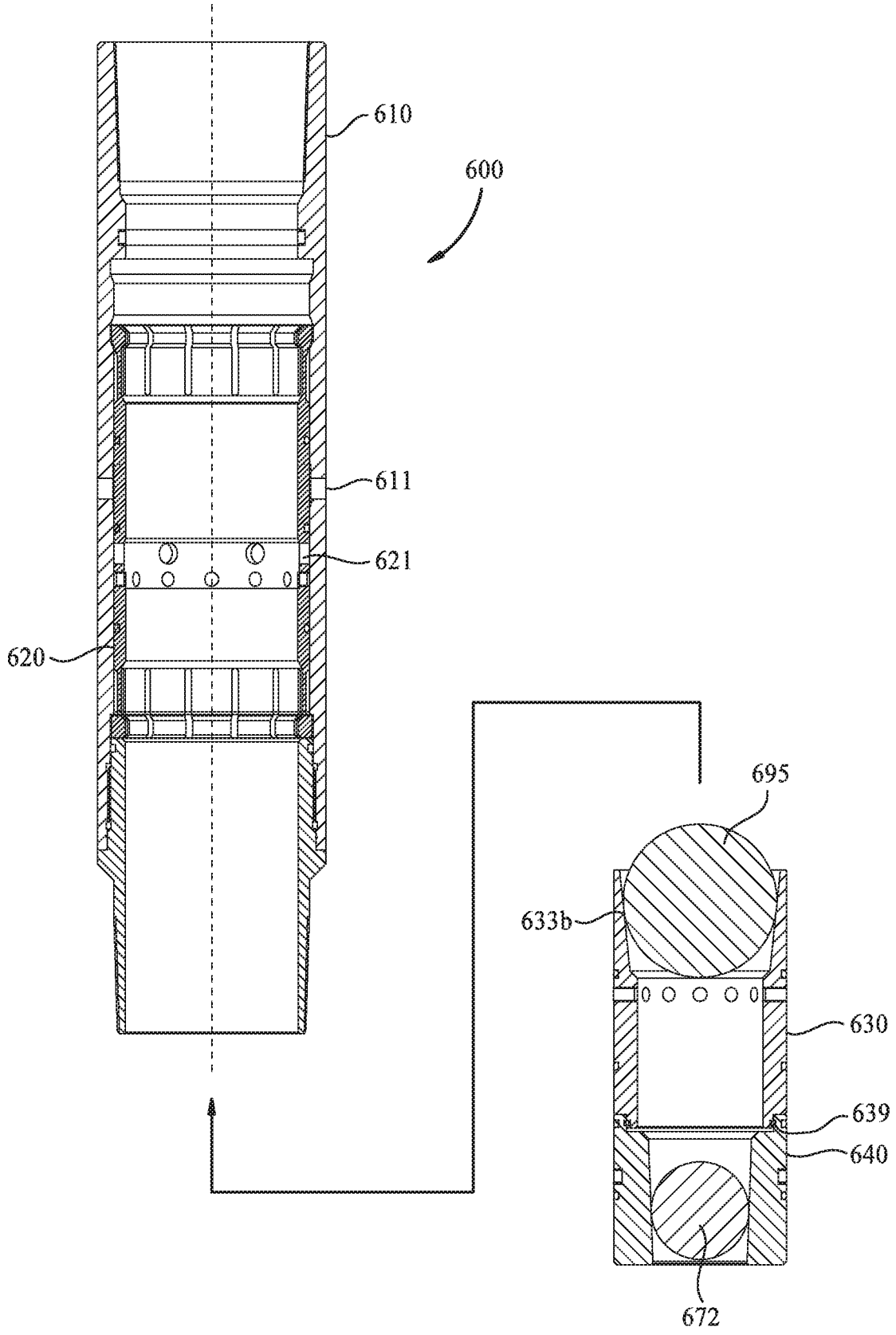
FIG. 18 illustrates an exemplary operation sequence of the stage tool of FIG. 13.

FIG. 18 shows the result of using a ball to release the upper sleeve 630 of the stage tool of FIG. 13. When the ports 111 are ready to be closed, a ball 695 is released behind the cement. The ball 695 lands on the seat 633*b* of the upper sleeve 630, thereby closing fluid communication through the upper sleeve 630. Pressure is increased sufficiently to shear the shear pins 632 retaining the upper sleeve 630 against the housing 610.

After release, the upper sleeve 630 moves downward relative to the housing 610. The upper and lower sleeves 630, 640 are connected when the snap ring 639 at the lower end of the upper sleeve 630 engages with the recessed groove 649 in the lower sleeve 640. Downward movement of the upper sleeve 630 also frees the upper collet heads 626*u* of the upper collet fingers 625*u* to move away from the groove 614*a*.

Pressure above the plug 675 urges the upper sleeve 630 and the lower sleeve 640 downward, which causes the port sleeve 620 to move downward relative to the housing 610. As a result, the ports 621 of the port sleeve 620 are moved out of alignment with ports 611 of the housing 610, thereby closing fluid communication through the ports 611 of the housing 610. The lower collet heads 626*l* flex outward to engage a groove 643*c* in the housing 610, which prevents the lower collet heads 626*l* from further downward movement or upward movement. No longer supported by the lower collet heads 626*l*, the lower sleeve 640, the ball 672, the upper sleeve 630, and the ball 695 are allowed to move downward relative to the housing 610.

In FIG. 18, the lower sleeve 640, the ball 672, the upper sleeve 630, and the ball 695 have moved out of and below the housing 610 of the stage tool 600. The stage tool 600 has gained full bore access.

In one embodiment, a flow control apparatus includes a housing having a bore extending and a port formed through a wall of the housing; a port sleeve disposed in the housing and having a port in communication with the port of the housing; a first sleeve releasably attached to the housing, wherein the first sleeve is movable from a first position preventing axial movement of the port sleeve relative to the housing to a second position allowing axial movement of the port sleeve relative to the housing; and a second sleeve releasably attached to the port sleeve, wherein the second sleeve is movable from a first position blocking fluid communication through the port of housing and the port of the port sleeve to a second position allowing fluid communication through the ports.

In one embodiment, a downhole tool assembly includes a flow control device, a packer; and a float collar assembly. The flow control device includes a housing having a bore extending and a port formed through a wall of the housing; a port sleeve disposed in the housing and having a port in fluid communication with the port of the housing; a first sleeve releasably attached to the housing, wherein the first sleeve is movable from a first position preventing axial movement of the port sleeve relative to the housing to a second position allowing axial movement of the port sleeve relative to the housing; and a second sleeve releasably attached to the port sleeve, wherein the second sleeve is movable from a first position blocking fluid communication through the port of housing and the port of the port sleeve to a second position allowing fluid communication through the ports.

In one or more of the embodiments described herein, the port of the port sleeve is aligned with the port of the housing.

In one or more of the embodiments described herein, the port sleeve includes an upper collet and a lower collet.

In one or more of the embodiments described herein, the first sleeve, in the first position, prevents the upper collet from disengaging from a recessed groove in the housing.

In one or more of the embodiments described herein, the lower collet supports the second sleeve when the second sleeve is in the second position.

In one or more of the embodiments described herein, the lower collet is engageable with a recessed groove in the housing, whereby the second sleeve is released from support of the lower collet.

In one or more of the embodiments described herein, the first sleeve and the second sleeve, after release, are movable out of the housing by fluid pressure.

In one or more of the embodiments described herein, the first sleeve includes a profile for retrieval to surface.

In one or more of the embodiments described herein, the first sleeve is attachable to the second sleeve for movement therewith.

In one or more of the embodiments described herein, the assembly includes a screen.

In one or more of the embodiments described herein, the float collar assembly includes a housing; a valve releasably attached to the housing; and a seat sleeve releasably attached to the housing.

In another embodiment, a method of operating a flow control device in a wellbore includes positioning the flow control device in the wellbore, the flow control device having a housing having a bore extending and a port formed through a sidewall; a port sleeve having a port in communication with the port of the housing; a first sleeve releasably attached to the housing and preventing axial movement of the port sleeve relative to the housing; and a second sleeve releasably attached to the port sleeve and blocking fluid communication through the port of housing and the port of the port sleeve. The method further includes releasing the second sleeve from the port sleeve, thereby allowing fluid communication through the port of the housing and the port of the port sleeve; releasing the first sleeve from the housing, thereby allowing axial movement of the port sleeve relative to the housing; moving the port sleeve relative to the housing, thereby closing fluid communication between the port of the port sleeve and the port of the housing; and moving the first sleeve and the second sleeve out of the housing.

In one embodiment, a method of supplying fluid into a wellbore includes blocking fluid communication through a float collar assembly; actuating a packer to seal an annular area between the wellbore and a tubular string; and opening a port in a flow control device for fluid communication with the annular area. The flow control device includes a housing having a bore extending and the port formed through a sidewall; a port sleeve having a port in fluid communication with the port of the housing; a first sleeve releasably attached to the housing; and a second sleeve releasably attached to the port sleeve, and wherein opening the port includes releasing the second sleeve from the port sleeve. The method also includes supplying fluid into the bore and out of the port of the port sleeve and the port of the housing; releasing the first sleeve from the housing, thereby allowing axial movement of the port sleeve relative to the housing; closing the port of the housing by moving the port sleeve relative to the housing; and moving the first sleeve and the second sleeve out of the housing.

In one or more of the embodiments described herein, the method includes using the port sleeve to retain the second sleeve after releasing the second sleeve.

In one or more of the embodiments described herein, the method includes landing the first sleeve on the second sleeve, after releasing the first sleeve.

In one or more of the embodiments described herein, moving the port sleeve comprises moving the port sleeve with the second sleeve.

In one or more of the embodiments described herein, the method includes releasing the second sleeve from the port sleeve prior to moving the second sleeve out of the housing.

In one or more of the embodiments described herein, the second sleeve is retained by a lower collet of the port sleeve.

In one or more of the embodiments described herein, the port sleeve prevents an upper collet from disengaging from a recessed groove in the housing.

In one or more of the embodiments described herein, releasing the second sleeve comprises releasing an object into the bore, and landing the object in the second sleeve.

In one or more of the embodiments described herein, releasing the first sleeve comprises releasing an object into the bore, and landing the object in the first sleeve.

In one or more of the embodiments described herein, moving the first sleeve and the second sleeve out of the housing comprises retrieving the first sleeve and the second sleeve to surface in a single trip.

In one or more of the embodiments described herein, the method includes supplying cement into the bore and out of the port of the housing.

In one or more of the embodiments described herein, the method includes attaching the first sleeve to the second sleeve prior to moving the first sleeve and the second sleeve out of the housing.

In one or more of the embodiments described herein, the float collar assembly includes a housing and a valve, and the method includes landing the second sleeve on the valve; and releasing the valve from the housing.

In one or more of the embodiments described herein, blocking communication through the float collar assembly comprises landing an object in a seat sleeve of the float collar assembly.

In one or more of the embodiments described herein, the method includes releasing the seal sleeve from a housing of the float collar assembly.

While the foregoing is directed to embodiments of the present invention, other and further embodiments of the invention may be devised without departing from the basic scope thereof, and the scope thereof is determined by the claims that follow.

We claim:

1. A flow control apparatus, comprising:

a housing having a bore extending and a port formed through a wall of the housing;

a port sleeve disposed in the housing and having a port in communication with the port of the housing;

a first sleeve releasably attached to the housing, wherein the first sleeve is movable from a first position preventing axial movement of the port sleeve relative to the housing to a second position allowing axial movement of the port sleeve relative to the housing; and a second sleeve releasably attached to the port sleeve, wherein the second sleeve is movable from a first position blocking fluid communication through the port of housing and the port of the port sleeve to a second position allowing fluid communication through the ports.

2. The apparatus of claim 1, wherein the port sleeve includes an upper collet and a lower collet.

3. The apparatus of claim 2, wherein the first sleeve, in the first position, prevents the upper collet from disengaging from a recessed groove in the housing.

4. The apparatus of claim 2, wherein the lower collet supports the second sleeve when the second sleeve is in the second position.

5. The apparatus of claim 4, wherein the lower collet is engageable with a recessed groove in the housing, whereby the second sleeve is released from support of the lower collet.

6. The apparatus of claim 1, wherein the first sleeve and the second sleeve, after release, are movable out of the housing by fluid pressure.

7. The apparatus of claim 1 wherein the first sleeve is attachable to the second sleeve for movement therewith.

8. The apparatus of claim 1, wherein the port of the port sleeve is aligned with the port of the housing.

9. The apparatus of claim 1, wherein the port sleeve is disposed between the housing and the second sleeve.

10. The apparatus of claim 9, wherein the port of the port sleeve is not aligned with the port of the housing after the port sleeve is allowed to move axially relative to the housing.

11. A method of operating a flow control device in a wellbore, comprising:

positioning the flow control device in the wellbore, the flow control device having:

a housing having a bore extending and a port formed through a sidewall;

a port sleeve having a port in communication with the port of the housing;

a first sleeve releasably attached to the housing and preventing axial movement of the port sleeve relative to the housing; and a second sleeve releasably attached to the port sleeve and blocking fluid communication through the port of housing and the port of the port sleeve;

releasing the second sleeve from the port sleeve, thereby allowing fluid communication through the port of the housing and the port of the port sleeve;

releasing the first sleeve from the housing, thereby allowing axial movement of the port sleeve relative to the housing;

moving the port sleeve relative to the housing, thereby closing fluid communication between the port of the port sleeve and the port of the housing; and moving the first sleeve and the second sleeve out of the housing.

12. The method of claim 11, further comprising using the port sleeve to retain the second sleeve after releasing the second sleeve.

13. The method of claim 12, further comprising landing the first sleeve on the second sleeve, after releasing the first sleeve.

14. The method of claim 13, wherein moving the port sleeve comprises moving the port sleeve with the second sleeve.

15. The method of claim 12, wherein the second sleeve is retained by a lower collet of the port sleeve.

16. The method of claim 15, wherein the port sleeve prevents an upper collet from disengaging from a recessed groove in the housing.

17. The method of claim 15, further comprising releasing the second sleeve from the port sleeve prior to moving the second sleeve out of the housing.

18. The method of claim 11, wherein releasing the second sleeve comprises releasing an object into the bore, and landing the object in the second sleeve.

19. The method of claim 11, wherein moving the first sleeve and the second sleeve out of the housing comprises retrieving the first sleeve and the second sleeve to surface in a single trip.

20. The method of claim 11, further comprising supplying cement into the bore and out of the port of the housing.

21. The method of claim 11, further comprising attaching the first sleeve to the second sleeve prior to moving the first sleeve and the second sleeve out of the housing.

22. A downhole tool assembly, comprising:

a flow control device, having:

a housing having a bore extending and a port formed through a wall of the housing;

a port sleeve disposed in the housing and having a port in fluid communication with the port of the housing;

a first sleeve releasably attached to the housing, wherein the first sleeve is movable from a first position preventing axial movement of the port sleeve relative to the housing to a second position allowing axial movement of the port sleeve relative to the housing; and a second sleeve releasably attached to the port sleeve, wherein the second sleeve is movable from a first position blocking fluid communication through the port of housing and the port of the port sleeve to a second position allowing fluid communication through the ports;

a packer; and a float collar assembly.

23. The assembly of claim 22, further comprising a screen.

24. The assembly of claim 22, wherein the float collar assembly includes:

a float housing;

a valve releasably attached to the float housing; and a seat sleeve releasably attached to the float housing.

25. The assembly of claim 22, wherein the port sleeve is disposed between the housing and the second sleeve.

26. A method of supplying fluid into a wellbore, comprising:

lowering a tubular string having a downhole tool assembly of claim 22;

blocking fluid communication through the float collar assembly;

actuating the packer to seal an annular area between the wellbore and the tubular string;

releasing the second sleeve from the port sleeve to open the port of the housing for fluid communication with the annular area;

supplying fluid into the bore and out of the port of the port sleeve and the port of the housing;

releasing the first sleeve from the housing, thereby allowing axial movement of the port sleeve relative to the housing;

closing the port of the housing by moving the port sleeve relative to the housing; and moving the first sleeve and the second sleeve out of the housing.

27. The method of claim 26, wherein the float collar assembly includes a housing and a valve, and the method includes landing the second sleeve on the valve; and releasing the valve from the housing.

28. The method of claim 26, wherein blocking communication through the float collar assembly comprises landing an object in a seat sleeve of the float collar assembly.

29. The method of claim 28, further comprising releasing the seat sleeve from a housing of the float collar assembly.

* * * * *